US010475421B1

(12) United States Patent
Chung

(10) Patent No.: US 10,475,421 B1
(45) Date of Patent: Nov. 12, 2019

(54) ADJUSTING MEMBER AND SOUND POST APPLIED THERETO

(71) Applicant: GlobalBell Group String Consultant Co., LTD., Taipei (TW)

(72) Inventor: Tsan-Hong Chung, Taipei (TW)

(73) Assignee: GLOBALBELL GROUP STRING CONSULTANT CO., LTD., Taipei (TW)

( * ) Notice: Subject to any disclaimer, the term of this patent is extended or adjusted under 35 U.S.C. 154(b) by 0 days.

(21) Appl. No.: 16/224,774

(22) Filed: Dec. 18, 2018

(30) Foreign Application Priority Data

Oct. 22, 2018 (CN) ..... 2018 2 1709555 U

(51) Int. Cl.

| | |
|---|---|
| ***G10D 3/02*** | (2006.01) |
| ***G10D 3/14*** | (2006.01) |
| ***G10D 1/00*** | (2006.01) |
| ***G10D 1/02*** | (2006.01) |

(52) U.S. Cl.
CPC ..... *G10D 3/02* (2013.01); *G10D 1/005* (2013.01); *G10D 1/02* (2013.01); *G10D 3/14* (2013.01)

(58) Field of Classification Search
CPC ..... G10D 3/02
USPC ..... 84/277
See application file for complete search history.

(56) References Cited

U.S. PATENT DOCUMENTS

| | | | | | |
|---|---|---|---|---|---|
| 878,124 | A * | 2/1908 | D'Armon | G10D 3/02 | 84/277 |
| 1,497,998 | A * | 6/1924 | Tarle | G10D 3/02 | 84/209 |
| 1,695,783 | A * | 12/1928 | Stephenson | G10D 3/02 | 84/277 |
| 1,819,796 | A * | 8/1931 | Sherman | G10D 3/02 | 84/276 |
| 2,060,357 | A * | 11/1936 | Williams | G10D 3/02 | 84/296 |
| 2,068,078 | A * | 1/1937 | Samuelson | G10D 3/02 | 84/276 |
| 2,141,735 | A * | 12/1938 | Borg | G10D 3/02 | 84/277 |
| 2,145,237 | A * | 1/1939 | Eberhart | G10D 3/02 | 84/277 |
| 2,162,595 | A * | 6/1939 | Virzi | G10D 3/02 | 84/277 |
| 2,236,701 | A * | 4/1941 | Virzi | G10D 3/04 | 84/277 |
| 2,370,460 | A * | 2/1945 | Patmor | G10D 3/02 | 84/277 |
| 3,603,193 | A * | 9/1971 | Archibald | G10D 3/02 | 84/309 |
| 4,026,181 | A * | 5/1977 | Barcus | G10D 3/00 | 84/291 |

(Continued)

*Primary Examiner* — Robert W Horn
(74) *Attorney, Agent, or Firm* — Cheng-Ju Chiang

(57) ABSTRACT

An adjusting member is pivoted on a sound post to adjust a length of the sound post from the outside of the sound box of a musical instrument. The adjusting member comprises a main body and at least one adjusting arm arranged on the main body. Through the sound post provided with the adjusting member, a user can easily adjust the tightness of the sound post against the upper and lower plates of the sound box through a hole of the sound box, such as F sound hole, connected with the outside to achieve the effect of adjusting timbre of the musical instrument.

16 Claims, 5 Drawing Sheets

(56) References Cited

U.S. PATENT DOCUMENTS

| | | | | | |
|---|---|---|---|---|---|
| 4,407,181 | A * | 10/1983 | Thomas | G10D 3/02 | 144/329 |
| 5,208,408 | A * | 5/1993 | Cave | G10D 3/02 | 84/277 |
| 5,307,721 | A * | 5/1994 | Ito | G10D 3/02 | 84/277 |
| 5,325,756 | A * | 7/1994 | Sugden | G10D 3/02 | 84/276 |
| 5,339,718 | A * | 8/1994 | Leduc | G10D 1/085 | 84/275 |
| 5,396,822 | A * | 3/1995 | Itokawa | G10D 3/02 | 84/276 |
| 5,804,748 | A * | 9/1998 | Clayton, Sr. | G10D 3/02 | 84/458 |
| 9,747,873 | B2 * | 8/2017 | Lee | G10D 3/02 | |
| 10,083,677 | B2 * | 9/2018 | Hamberger | G10D 3/14 | |
| 2008/0190263 | A1 * | 8/2008 | Drew | G10D 3/02 | 84/291 |
| 2009/0277319 | A1 * | 11/2009 | Beter | G10D 3/02 | 84/277 |
| 2010/0083806 | A1 * | 4/2010 | Peavey | G10D 3/02 | 84/294 |
| 2012/0011983 | A1 * | 1/2012 | Koumarianos | G10D 1/02 | 84/291 |

* cited by examiner

ADJUSTING MEMBER AND SOUND POST APPLIED THERETO

TECHNICAL FIELD

The present invention relates to an adjusting member and a sound post applied thereto, so as to enable a user to easily adjust the length of a sound post from the outside of the sound box of a musical instrument.

BACKGROUND OF RELATED ARTS

In Western or Eastern cultures, in music-related fields, many musical instruments have a sound box structure that can facilitate to adjust the quality and volume of the instrument. For example, many electronic musical instruments, percussion instruments or string instruments have similar sound box structures.

String instruments play an important role in many kinds of musical instruments. One of the most famous instruments in the Western is the violin. Even modern eastern Chinese music has also introduced the Western violoncello as one key instrument in bass performance. In general, the structure of string instruments is mainly composed of boards with different curvatures to make a structure of the sound box, and the sound post plays an important role in affecting the sound quality and volume of the string instrument.

Usually, a sound box of the string instrument is composed of a top board (roof), a bottom board (back plate) and a side board. For violin instrument, there is a curvature profile on the top board and the bottom board. The sound post is mounted between the top board and the bottom board.

The location of the sound post is mainly located on an area below the bridge of violin instrument. The bridge is usually made of a piece of wood in a special shape, which mainly transmits vibration of the strings to the sound box to produce sound. In the traditionally manufacturing process, the sound post is a wooden cylinder, with specific length and shape of its two ends fitted to the sound box against the top board and the bottom board. Because the top board and the bottom board usually have a certain curvature, it is usually necessary to constantly cut the two ends of the sound post to fit to the shape of the top board and the bottom board in the sound box during installing the sound post.

The sound post can effectively improve the stability and sound quality of string instruments. For a violin, the sound post can only be mounted through the sole opening, f-hole, of the sound box. Therefore, it is a time-consuming and labor-consuming process to cut the sound post manually and gradually install it into the sound box of string instruments. Therefore, some people have developed a sound post structure which can adjust the length of the sound post or the curvature of the top board and the bottom board of the sound box after the sound post is introduced into the f hole. However, when adjusting the length and position of such a sound post, it still needs external tools to penetrate the f hole for more precise operation. As a result, in addition to the considerable increase in operational difficulty, the tool structure used to adjust the length of the sound post is also complicated.

Moreover, when the tightness of the sound post against the top board and the bottom board changes, there is a need to adjust the sound post at any time due to the corresponding changes of timbre of the instrument. However, when this situation occurs, there is no a professional adjustment tool at hand, it will cause inconvenience in use.

SUMMARY

To resolve the drawbacks of the prior arts, the present invention discloses an adjusting member, comprising a main body and at least one adjusting arm mounted on the main body; wherein the at least one adjusting arm has a rod-shaped, and the adjusting member can be pivoted on a sound post.

The adjusting member can be applied to any-type sound post. The sound post provided with an adjusting member, comprising a first post, a screw post and a second post. The first post is provided with a first hollow thread and a first fit part. The screw post is pivoted on the first hollow thread. The second post is provided with a second hollow thread and a second fit part, and the second hollow thread is pivoted to the screw post. The adjusting member is pivoted on the screw post and arranged between the first post and the second post.

Embodiments of the invention are illustrated by way of example, and not by way of limitation, in the figures of the accompanying drawings in which like reference numerals refer to similar elements:

BRIEF DESCRIPTION OF THE DRAWINGS

In order to clearly illustrate the embodiments of the present invention, a brief description of the accompanying drawings to be used in the embodiments will be given below. Obviously, the accompanying drawings described below are only some of the embodiments of the present invention and, for those of ordinary skill in the art, other drawings can be obtained according to the structure shown in the drawings.

Figure 1:
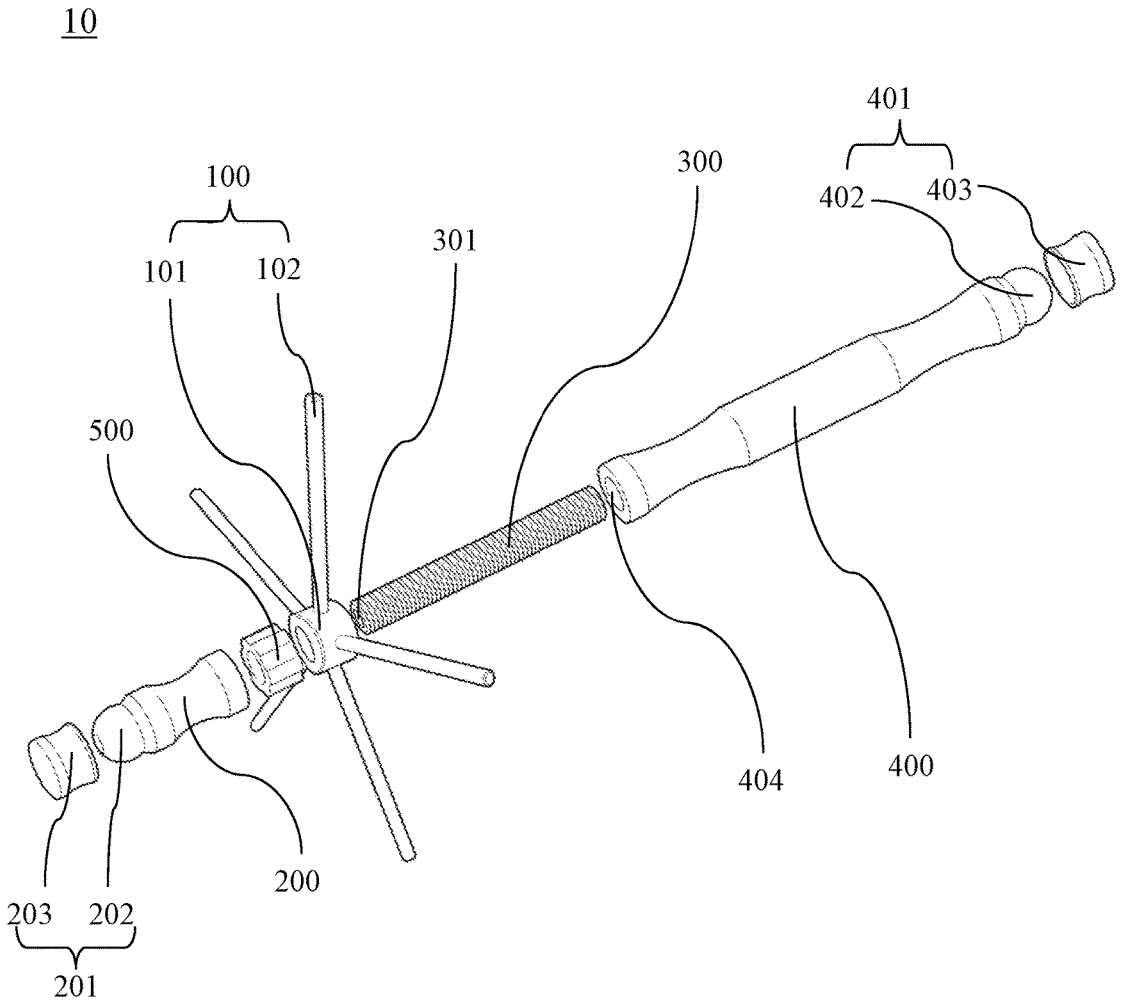
FIG. 1 is a schematic diagram of a structure of an embodiment of the present invention.

The implementations, functional characteristics and advantages of the present invention will be further illustrated with reference to the drawings in combination with the embodiments.

DETAILED DESCRIPTION OF THE INVENTION

In order to understand the technical features and practical efficacy of the present invention and to implement it in accordance with the contents of the specification, hereinafter, preferred embodiments of the present invention will be described in detail with reference to the accompanying drawings.

It should be noted that all directional indications (such as upper, lower, left, right, front, rear, etc.) in some embodiments of the present invention are only used to explain the relative position relationship, motion conditions, etc. between the components in a particular condition (as shown in the drawings). If the particular condition changes, the directional indication changes accordingly.

In the present invention, the terms "connection" and "fixation" should be understood in a broad interpretation unless otherwise specified and defined. For example, "fixation" may be a fixed connection, a detachable connection, or an integral whole; "connection" may be a mechanical connection, or an electrical connection; it may be a direct connection, or it may be indirectly connected through an intermedia; and can be connected within two components or the interaction between two components unless otherwise specified. For those of ordinary skill in the art, the specific meaning of the above-mentioned terms in the present invention can be understood according to specific cases.

In addition, descriptions relating to "first" and "second" in the present invention are used only for descriptive purposes and are not understood to indicate or imply their relative importance or to imply the number of the indicated technical features. Thus, the features defined as "first" and "second" may explicitly or implicitly include at least one of the features. In addition, the technical schemes among the various embodiments may be integrated with each other, but must be achieved based on the ability of a person of ordinary skill in the art. When the combination of technical schemes is inconsistent or impossible to achieve, it should be considered that the combination of such technical schemes does not exist, nor is it within the claim scape of the invention.

Figure 3:
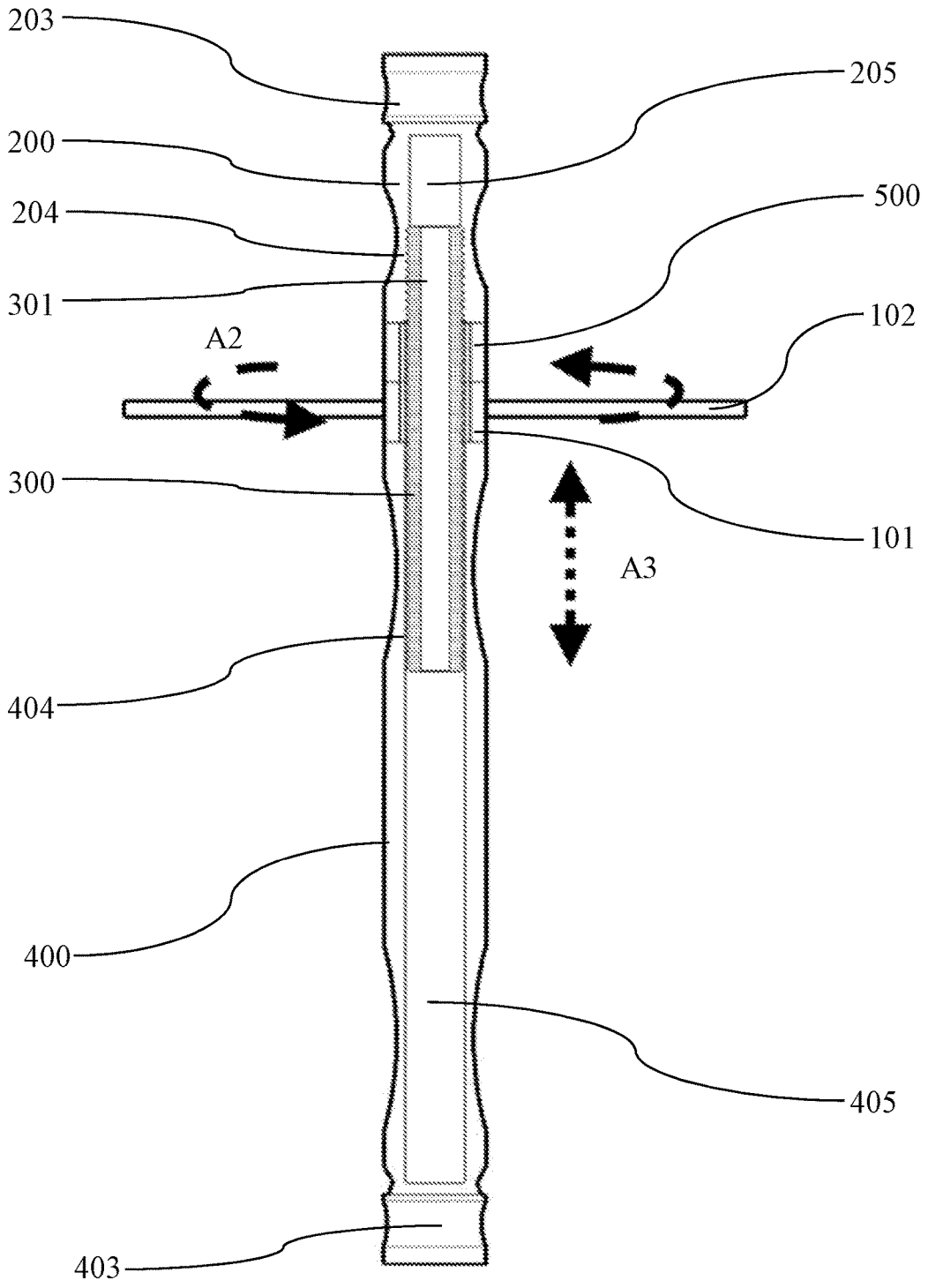
FIG. 3 is a sectional diagram of the structure of one embodiment of the invention.

Referring to FIG. 1 and FIG. 3, FIG. 1 is a schematic diagram of a structure of an embodiment of the present invention, and FIG. 3 is a sectional diagram of the structure of an embodiment of the present invention.

As shown in FIG. 1 and FIG. 3, the adjusting member 100 of the embodiment of the present invention is made up of a main body 101 and at least one adjusting arm 102. The main body 101 has a short and small columnar structure, and the at least one adjusting arm 102 is mounted on the main body 101. In the present embodiment, the adjusting arm 102 has a long rod-shaped, and the long rod-shaped is cylindrical long rod-shaped, and the adjusting member 100 is pivoted/revolved (rotated) on the sound post 10 to become a part of the sound post 10.

Of course, the adjusting member 100 in this embodiment can be applied to any adjustable sound post 10. In this embodiment, material of the adjusting member 100 is aluminum or aluminum alloy. In addition, the adjusting member 100 is coated with a first coating, and material of the first coating is selected from titanium, titanium nitride, titanium carbide, copper, gold, nickel and combinations thereof. In other embodiments, a second coating is coated on the first coating, and material of the second coating is diamond-like carbon (DLC).

In this embodiment, the first coating and the second coating may be implemented by a physical or chemical coating process of sputtering, plasma, laser or electric arc. Because the sound post plays a role of transmitting sound vibration, through the coating process, the hardness of all components of the sound post 10 can be greatly enhanced such that the sound conduction effect is excellent and clear music can be created.

Therefore, in other embodiments, the adjusting member 100 can be coated with the first and second coatings, and the other components used in the sound post 10 can also be coated with the same first and second coatings.

Figure 2:
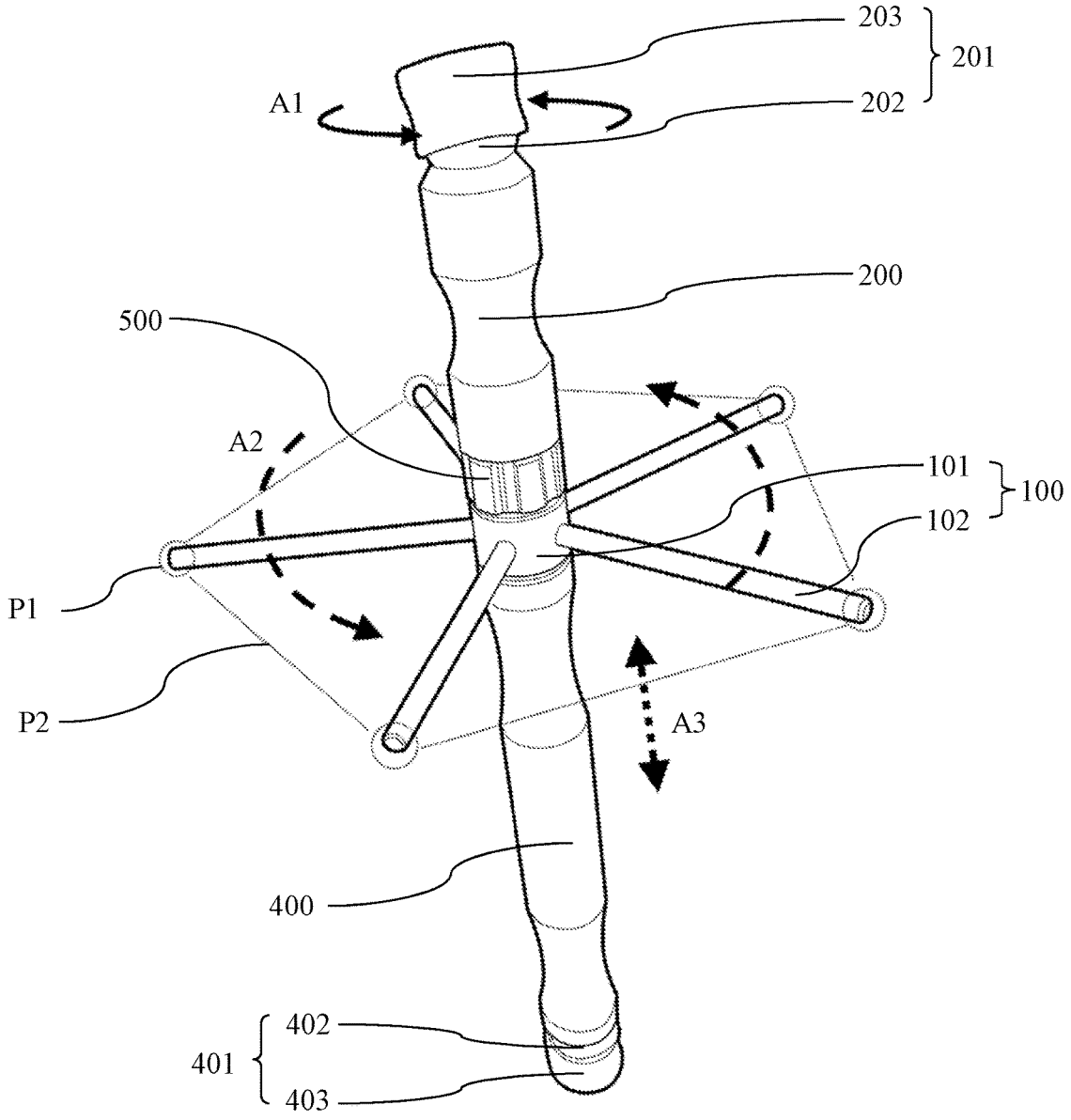
FIG. 2 is a diagram of three-dimensional structurally actuating of one embodiment of the present invention.

For a better understanding of the structural features of the adjusting member 100 of the present invention, please refer to FIG. 2, it illustrates a diagram of three-dimensional structurally actuating of one embodiment of the present invention. As shown in FIG. 2, it can be seen that a number of the at least adjusting arm 102 in the adjusting member 100 is five and the at least one adjusting arm 102 is configured perpendicularly to the main body 101, and endpoint P1 of each adjusting arm 102 jointly forms a regular pentagon along the indicating line P2. Accordingly, when the tightness of the sound post 10 is needed to be adjusted, any of the rod-shaped objects can be directly inserted into the music instrument, and the whole adjusting member 100 can be rotated along the direction of an arrow A2 against any adjusting arm 102. When the main body 101 of the adjusting member 100 rotates in the direction of the arrow A2, it moves along an arrow A3 on a stud (screw post) 300 to adjust length of the whole sound post 10, accordingly to achieve the purpose of adjusting the tightness of the sound post.

In the present embodiment, the main body 101 and the adjusting arm 102 in the adjusting member 100 may be integrally formed, or the adjusting arm 102 may be tightly bonded to the main body 101 by an ebonite adhesive. The parts of the present embodiment are in a very tight bonding state when they are fixed. Besides the merits of the coating, noise of vibration and collision between the components caused by non-tightly combining of the sound post 10 in resonance can be avoided as the sound post 10 is in resonance.

As shown in FIG. 1-3, the sound post 10 provided with the adjusting member 100 in this embodiment comprises a first post 200, a screw post 300 and a second post 400. The first post 200 is provided with a first hollow thread 204 and a first fit part 201, and the screw post 300 is pivoted (rotated) to the first hollow thread 204.

The second post 400 is provided with a second hollow thread 404 and a second fit part 401, and the second hollow thread 404 is pivoted to the screw post 300. The adjusting member 100 is pivoted on the screw post 300 and arranged between the first post 200 and the second post 400.

The first fit part 201 comprises a first spherical joint 202 and a first cap 203, and the first cap 203 is located on the first spherical joint 202. Similarly, the second fit part 401 comprises a second spherical joint 402 and a second cap 403, and the second cap is located on the second spherical joint 402. Therefore, taking the first fit part 201 as an example, the first fit part 201 can rotate arbitrarily in the direction of the arrow A1 shown in FIG. 2 to adjust the angle, which is fitted to sound box with a curvature of a music instrument.

In addition, in this embodiment, a regulating member 500 is also pivoted on the screw post 300. The purpose of the regulating member 500 is to fix the first post 200 to stabilize its structure and prevent sound noise caused by the slight vibration and collision of the components.

As shown in FIG. 3, in this embodiment, the screw post 300 is provided with a hollow part 301. In addition, the first hollow thread 204 is connected with the first sound chamber 205, and the second hollow thread 404 is connected with the second sound chamber 405. The first sound chamber 205, the first hollow thread 204 and the second sound chamber 405, the second hollow thread 404 are connected through the hollow part 301. In this embodiment, function of the first sound chamber 205 and the second sound chamber 405 is to adjust resonance sound of the sound post 10. Through the connection of the hollow part 301, the resonance effect can be better.

In particular, material of the screw post 300 is aluminum or aluminum alloy. In addition, a first coating material is coated on the screw post 300, and material of the first coating is selected from titanium, titanium nitride, titanium carbide, copper, gold, nickel and the combination thereof; a second coating is coated on the first coating, and material of the second coating is diamond-like carbon (DLC). In this embodiment, the screw post 300 is also coated with the coatings same as the adjusting member 100, and the screw post 300 bridges the first post 200 and the second post 400. Material of screw post 300 and double coating can provide excellent vibration transmission media.

Figure 4:
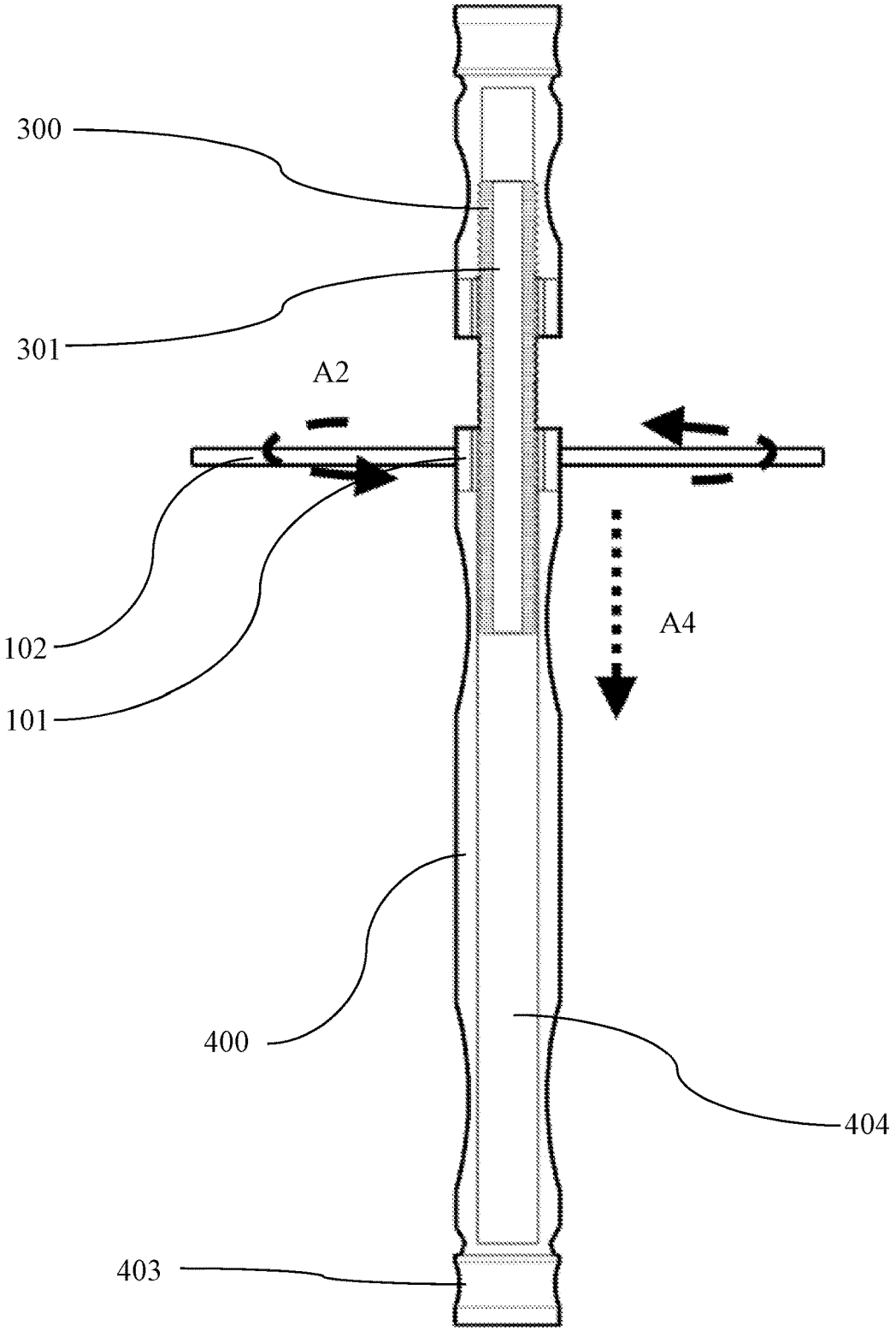
FIG. 4 illustrates a sectional diagram of three-dimensional structurally actuating of one embodiment of the invention.

Referring to FIG. 2 and FIG. 4, FIG. 4 illustrates a sectional diagram of three-dimensional structurally actuating of one embodiment of the invention. As shown in FIG. 2 and FIG. 4, as the adjusting member 100 can be rotated along the direction of the arrow A2, the second post 400 moves in the direction of the arrow A3, and thereby adjusting the length of the sound post 10. In FIG. 4, when the adjusting member 100 rotates in the direction of the arrow A2, the second post 400 moves downward in the direction of the arrow A4. The tightness of the sound post 10 against the music instrument is increased.

Figure 5:
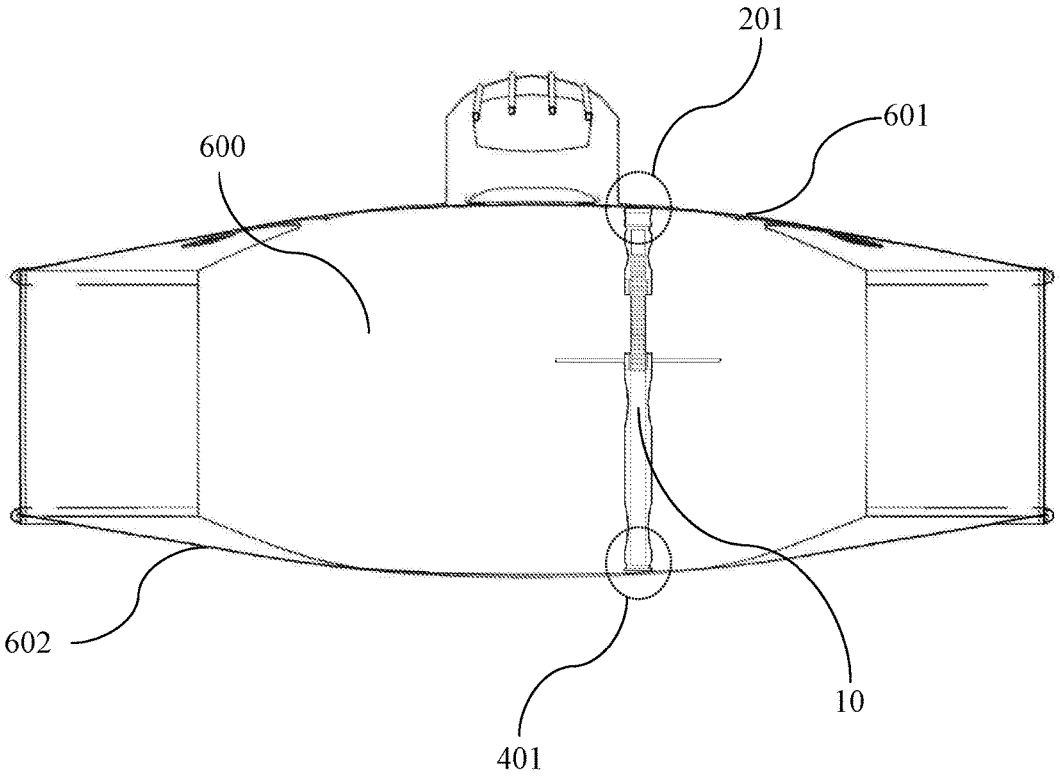
FIG. 5 illustrates an actual installation diagram of one embodiment of the invention.

Please refer to FIG. 5, FIG. 5 illustrates an actual installation diagram of an embodiment of the invention. The advantage of this embodiment to operate with the adjusting member 100 is that a user can install this sound post 10 through the first post 200, the screw post 300 and the second post 400 installed by utilizing the adjusting member 100 straightly entering into the F sound hole to horizontal state. Subsequently, the first fit part 201 and the second fit part 401 on the first post 200 and the second post 400 are placed sequentially against an upper plate (board) 601 and a lower plate (board) 602 of the sound box 600 of a musical instrument so that the first cap 202 and the second cap 402 can be rotated along the arrow A1 in FIG. 2 to fit to the upper plate 601 and the lower plate 602. After the fitting operation is completed, any long rod-shaped object can be inserted into the sound box 600 of the musical instrument, and the adjusting member 100 can be intuitively rotated to control the tightness of the sound post 10 against the upper plate 601 and the lower plate 602 of the sound box 600, so as to adjust the timbre and resonance effect of the musical instrument.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structure. While the preferred embodiment of the invention has been illustrated and described, it will be appreciated that various changes can be made therein without departing from the spirit and scope of the invention.

What is claimed is:

1. An adjusting member, comprising:

a main body; and at least one adjusting arm mounted on said main body;

wherein said at least one adjusting arm has a rod-shaped, and said adjusting member is pivoted on a sound post.

2. The adjusting member of claim 1, wherein material of said adjusting member is aluminum or aluminum alloy.

3. The adjusting member of claim 2, further comprising a first coating coated on said adjusting member.

4. The adjusting member of claim 3, wherein material of said first coating is selected from titanium, titanium nitride, titanium carbide, copper, gold, nickel and combinations thereof.

5. The adjusting member of claim 4, further comprising a second coating coated on said first coating.

6. The adjusting member of claim 5, wherein material of said second coating is diamond-like carbon.

7. The adjusting member of claim 1, wherein said rod-shaped is cylindrical rod-shaped.

8. The adjusting member of claim 1, wherein number of said at least adjusting arm is five and said at least one adjusting arm is configured perpendicularly to said main body, and an endpoint of each said at least one adjusting arm jointly forms a regular pentagon.

9. The adjusting member of claim 1, wherein said main body and said at least one adjusting arm are integrally formed.

10. A sound post provided with an adjusting member, comprising:

a first post provided with a first hollow thread and a first fit part;

a screw post pivoted on said first hollow thread;

a second post provided with a second hollow thread and a second fit part, and wherein said second hollow thread is pivoted to said screw post;

wherein said adjusting member is pivoted on said screw post and arranged between said first post and said second post;

wherein said adjusting member comprises:

a main body; and at least one adjusting arm mounted on said main body.

11. The sound post of claim 10, wherein said first fit part comprises a first spherical joint and a first cap, and said first cap is located on said first spherical joint screw post;

wherein said second fit part comprises a second spherical joint and a second cap, and said second cap is located on said second spherical joint;

wherein said first fit part on said first post and said second fit part on said second post are against an upper plate and a lower plate of a sound box of a musical instrument, respectively.

12. The sound post of claim 10, wherein said screw post is provided with a hollow part.

13. The sound post of claim 12, wherein said first hollow thread is connected with a first sound chamber, and said second hollow thread is connected with a second sound chamber, and wherein said first sound chamber, said first hollow thread and said second sound chamber, said second hollow thread are connected through said hollow part.

14. The sound post of claim 10, further comprising a regulating member pivoted on said screw post.

15. The sound post of claim 10, wherein material of said screw post is aluminum or aluminum alloy.

16. The sound post of claim 10, further comprising a first coating material coated on said screw post, and material of said first coating is selected from titanium, titanium nitride, titanium carbide, copper, gold, nickel and combinations thereof; a second coating coated on said first coating, and material of said second coating is diamond-like carbon.

* * * * *